US008601716B2

(12) United States Patent
Jerg et al.

(10) Patent No.: US 8,601,716 B2
(45) **Date of Patent: *Dec. 10, 2013**

(54) METHOD FOR OPERATING A DEVICE WITH AT LEAST ONE PARTIAL PROGRAMME STEP OF DRYING

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1702 days.

This patent is subject to a terminal disclaimer.

(21) Appl. No.: 10/562,105

(22) PCT Filed: Jul. 5, 2004

(86) PCT No.: PCT/EP2004/007338

§ 371 (c)(1),
(2), (4) Date: Dec. 22, 2005

(87) PCT Pub. No.: WO2005/018410

PCT Pub. Date: Mar. 3, 2005

(65) Prior Publication Data

US 2007/0101609 A1 May 10, 2007

(30) Foreign Application Priority Data

Jul. 30, 2003 (DE) ..... 103 34 791
Nov. 18, 2003 (DE) ..... 103 53 775

(51) Int. Cl.
*F26B 11/00* (2006.01)

(52) U.S. Cl.
USPC ..... 34/329; 34/332; 34/381; 95/12; 96/94; 62/271; 68/13 R; 8/137

(58) Field of Classification Search
USPC ..... 34/329, 332, 361, 381, 444, 472; 95/12; 96/94, 117.5; 62/271, 470; 68/13 R, 19, 68/20; 8/137, 149, 159
See application file for complete search history.

(56) References Cited

U.S. PATENT DOCUMENTS 2,340,345 A * 2/1944 Richeson ..... 34/575
2,411,039 A * 11/1946 Heuser ..... 34/557

(Continued)

FOREIGN PATENT DOCUMENTS

DE 2 016831 10/1971
DE 3512593 A1 * 9/1985

(Continued)

OTHER PUBLICATIONS

International Search Report PCT/EP2004/007338.

*Primary Examiner* — Steve M Gravini
(74) *Attorney, Agent, or Firm* — James E. Howard; Andre Pallapies

(57) ABSTRACT

A method for operating a device with at least one partial programme step of drying may be achieved with which it is possible to operate devices with at least a partial operating step of drying as economically as possible, with efficient drying of the material for drying and keeping the associated energy requirement as low as possible, whereby, during the at least one partial programme step of drying, air is drawn from a treatment chamber and/or from the ambient air, through an absorption column and then introduced into the treatment chamber, whereby the absorption column contains a reversible dehydrating agent and humidity is drawn from the air during the passage thereof.

11 Claims, 1 Drawing Sheet

(56) References Cited

U.S. PATENT DOCUMENTS

| | | | | | |
|---|---|---|---|---|---|
| 2,519,873 | A | * | 8/1950 | Berg | 95/112 |
| 2,549,104 | A | * | 4/1951 | Lechthaler | 95/110 |
| 2,633,928 | A | * | 4/1953 | Chamberlain | 96/111 |
| 2,674,338 | A | * | 4/1954 | Lindsay et al. | 423/239.1 |
| 2,858,279 | A | * | 10/1958 | Drews | 502/44 |
| 3,020,128 | A | * | 2/1962 | Adcock et al. | 75/395 |
| 3,031,381 | A | * | 4/1962 | Langerhans | 34/443 |
| 3,034,221 | A | | 5/1962 | Tuck et al. | |
| 3,241,248 | A | * | 3/1966 | Richard et al. | 34/443 |
| 3,304,623 | A | * | 2/1967 | Reiss et al. | 34/80 |
| 3,342,629 | A | * | 9/1967 | Martin | 428/541 |
| 3,374,052 | A | * | 3/1968 | Liang-Tseng et al. | 423/653 |
| 3,387,385 | A | * | 6/1968 | Mandarino, Jr. et al. | 34/596 |
| 3,417,481 | A | * | 12/1968 | Rumsey, Jr. | 34/72 |
| 3,458,941 | A | * | 8/1969 | Gidlow | 34/299 |
| 3,490,355 | A | * | 1/1970 | Groth et al. | 426/473 |
| 3,507,051 | A | * | 4/1970 | Calvert et al. | 34/340 |
| 3,666,621 | A | * | 5/1972 | Adams | 162/198 |
| 3,728,074 | A | * | 4/1973 | Victor | 8/142 |
| 3,729,835 | A | * | 5/1973 | Massett | 34/225 |
| 3,861,054 | A | * | 1/1975 | Stahl | 34/359 |
| 3,991,154 | A | * | 11/1976 | Zimmer et al. | 423/6 |
| 4,023,940 | A | * | 5/1977 | Shultz | 96/112 |
| 4,077,135 | A | * | 3/1978 | Tzschoppe et al. | 34/593 |
| 4,112,590 | A | * | 9/1978 | Muller | 34/75 |
| 4,124,528 | A | * | 11/1978 | Modell | 210/670 |
| 4,125,946 | A | * | 11/1978 | Prager | 34/80 |
| 4,180,919 | A | * | 1/1980 | Baltes | 34/449 |
| 4,204,339 | A | * | 5/1980 | Muller | 34/75 |
| 4,248,706 | A | * | 2/1981 | Repik | 210/673 |
| 4,251,923 | A | * | 2/1981 | Kuri | 34/412 |
| 4,283,204 | A | * | 8/1981 | Savage | 95/27 |
| 4,389,422 | A | * | 6/1983 | Hudak | 426/388 |
| 4,475,295 | A | * | 10/1984 | Hussmann | 96/125 |
| 4,480,393 | A | * | 11/1984 | Flink et al. | 34/468 |
| 4,497,121 | A | * | 2/1985 | Choinski | 34/445 |
| 4,513,590 | A | * | 4/1985 | Fine | 68/18 C |
| 4,581,047 | A | * | 4/1986 | Larsson | 96/131 |
| 4,621,437 | A | * | 11/1986 | Grande et al. | 34/361 |
| 4,622,757 | A | * | 11/1986 | Bernstein et al. | 34/259 |
| 4,652,278 | A | * | 3/1987 | Oliker | 34/448 |
| 4,715,965 | A | * | 12/1987 | Sigerson et al. | 210/511 |
| 4,741,882 | A | * | 5/1988 | Weichselgartner | 422/122 |
| 4,756,726 | A | * | 7/1988 | Peace | 96/117.5 |
| 4,761,162 | A | * | 8/1988 | Ratcliffe et al. | 44/626 |
| 4,765,162 | A | * | 8/1988 | Ouellette | 68/20 |
| 4,769,921 | A | * | 9/1988 | Kabakov et al. | 34/469 |
| 4,805,317 | A | * | 2/1989 | Inglis et al. | 34/259 |
| 4,817,296 | A | * | 4/1989 | Kabakov et al. | 34/77 |
| 4,887,438 | A | * | 12/1989 | Meckler | 62/271 |
| 5,003,143 | A | * | 3/1991 | Marks et al. | 219/685 |
| 5,058,401 | A | * | 10/1991 | Nakamura et al. | 68/19.2 |
| 5,120,500 | A | * | 6/1992 | Eggersdorfer et al. | 422/40 |
| 5,146,693 | A | * | 9/1992 | Dottor et al. | 34/77 |
| 5,151,116 | A | * | 9/1992 | Scholz et al. | 96/131 |
| 5,154,008 | A | * | 10/1992 | Chicot | 34/73 |
| 5,163,235 | A | * | 11/1992 | Hoffmann et al. | 34/60 |
| 5,214,924 | A | * | 6/1993 | Karthaus et al. | 62/617 |
| 5,230,167 | A | * | 7/1993 | Lahoda et al. | 34/75 |
| 5,343,632 | A | * | 9/1994 | Dinh | 34/507 |
| 5,347,610 | A | * | 9/1994 | Lee | 392/447 |
| 5,361,514 | A | * | 11/1994 | Lahoda et al. | 34/391 |
| 5,373,704 | A | * | 12/1994 | McFadden | 62/94 |
| 5,405,579 | A | * | 4/1995 | Melzer et al. | 422/26 |
| 5,479,727 | A | * | 1/1996 | Fine et al. | 34/516 |
| 5,526,651 | A | * | 6/1996 | Worek et al. | 62/271 |
| 5,542,259 | A | * | 8/1996 | Worek et al. | 62/94 |
| 5,628,122 | A | * | 5/1997 | Spinardi | 34/79 |
| 5,631,685 | A | * | 5/1997 | Gooray et al. | 347/102 |
| 5,656,178 | A | * | 8/1997 | Marchesi et al. | 210/770 |
| 5,669,154 | A | * | 9/1997 | Bellomo | 34/71 |
| 5,678,324 | A | * | 10/1997 | Viitaniemi et al. | 34/396 |
| 5,689,893 | A | * | 11/1997 | Mitsch | 34/80 |
| 5,713,137 | A | * | 2/1998 | Fujita | 34/106 |
| 5,735,194 | A | * | 4/1998 | Cochran | 99/483 |
| 5,814,224 | A | * | 9/1998 | Khamizov et al. | 210/638 |
| 5,832,750 | A | * | 11/1998 | Yamamoto | 68/13 R |
| 5,882,381 | A | * | 3/1999 | Hauck et al. | 95/109 |
| 6,000,144 | A | * | 12/1999 | Bussmann et al. | 34/332 |
| 6,094,835 | A | * | 8/2000 | Cromer | 34/80 |
| 6,158,144 | A | * | 12/2000 | Weber et al. | 34/335 |
| 6,161,306 | A | * | 12/2000 | Clodic | 34/321 |
| 6,163,979 | A | * | 12/2000 | Oetjen et al. | 34/286 |
| 6,189,236 | B1 | * | 2/2001 | Gaines et al. | 34/329 |
| 6,213,029 | B1 | * | 4/2001 | Potter et al. | 110/229 |
| 6,228,394 | B1 | * | 5/2001 | Horhota et al. | 424/456 |
| 6,240,654 | B1 | * | 6/2001 | Weber et al. | 34/335 |
| 6,387,158 | B2 | * | 5/2002 | Ikeda et al. | 95/97 |
| 6,418,834 | B1 | * | 7/2002 | Perrine | 99/334 |
| 6,434,857 | B1 | | 8/2002 | Anderson et al. | |
| 6,554,507 | B2 | * | 4/2003 | Namatsu | 396/611 |
| 6,613,865 | B1 | * | 9/2003 | Magunia et al. | 528/59 |
| 6,658,757 | B2 | * | 12/2003 | Fout et al. | 34/76 |
| 6,748,772 | B2 | * | 6/2004 | Lee et al. | 68/18 C |
| 6,829,844 | B2 | * | 12/2004 | Brady et al. | 34/381 |
| 6,886,273 | B2 | * | 5/2005 | Fout et al. | 34/470 |
| 6,892,473 | B1 | * | 5/2005 | Chiang et al. | 34/332 |
| 6,899,281 | B1 | * | 5/2005 | Griese et al. | 239/60 |
| 7,020,986 | B1 | * | 4/2006 | Nakai et al. | 34/596 |
| 7,055,761 | B2 | * | 6/2006 | Griese et al. | 239/60 |
| 7,093,772 | B2 | * | 8/2006 | Griese et al. | 239/43 |
| 7,191,547 | B2 | * | 3/2007 | Wiedl et al. | 34/264 |
| 7,311,267 | B2 | * | 12/2007 | Griese et al. | 239/43 |
| 7,326,347 | B2 | * | 2/2008 | Williams et al. | 210/661 |
| 7,341,066 | B2 | * | 3/2008 | Oh et al. | 134/11 |
| 7,370,436 | B2 | * | 5/2008 | Auer et al. | 34/403 |
| 7,469,486 | B2 | * | 12/2008 | Tamura et al. | 34/77 |
| 7,520,146 | B2 | * | 4/2009 | Kim et al. | 68/15 |
| 7,585,373 | B2 | * | 9/2009 | Jerg et al. | 134/10 |
| 7,591,859 | B2 | * | 9/2009 | Wong et al. | 8/149.3 |
| 7,610,778 | B2 | * | 11/2009 | Oh et al. | 68/5 R |
| 7,627,920 | B2 | * | 12/2009 | Wong et al. | 8/159 |
| 2003/0000106 | A1 | * | 1/2003 | Anderson et al. | 34/598 |
| 2003/0079370 | A1 | * | 5/2003 | Fout et al. | 34/472 |
| 2003/0192197 | A1 | * | 10/2003 | Griese et al. | 34/444 |
| 2004/0045187 | A1 | * | 3/2004 | Curry et al. | 34/595 |
| 2004/0064969 | A1 | * | 4/2004 | Fout et al. | 34/507 |
| 2004/0159004 | A1 | * | 8/2004 | Brady et al. | 34/218 |
| 2004/0159006 | A1 | * | 8/2004 | Griese et al. | 34/444 |
| 2004/0237328 | A1 | * | 12/2004 | Auer et al. | 34/92 |
| 2005/0086830 | A1 | * | 4/2005 | Zukor et al. | 34/443 |
| 2005/0120581 | A1 | * | 6/2005 | Chiang et al. | 34/332 |
| 2005/0139523 | A1 | * | 6/2005 | Palmer | 209/155 |
| 2005/0236333 | A1 | * | 10/2005 | Williams et al. | 210/660 |
| 2005/0268481 | A1 | * | 12/2005 | Wiedl et al. | 34/416 |
| 2006/0278257 | A1 | * | 12/2006 | Jerg et al. | 134/56 D |
| 2007/0000146 | A1 | * | 1/2007 | Boonstra et al. | 34/396 |
| 2007/0094887 | A1 | * | 5/2007 | Philipp et al. | 34/282 |
| 2007/0101609 | A1 | * | 5/2007 | Jerg et al. | 34/416 |
| 2007/0234588 | A1 | * | 10/2007 | Classen et al. | 34/331 |
| 2007/0245899 | A1 | * | 10/2007 | Merdzo | 96/108 |
| 2007/0295360 | A1 | * | 12/2007 | Jerg et al. | 134/10 |
| 2007/0295370 | A1 | * | 12/2007 | Jerg et al. | 134/56 D |
| 2007/0295373 | A1 | * | 12/2007 | Jerg et al. | 134/105 |
| 2008/0028632 | A1 | * | 2/2008 | Py | 34/285 |
| 2008/0083433 | A1 | * | 4/2008 | Jerg et al. | 134/18 |
| 2008/0110832 | A1 | * | 5/2008 | Williams et al. | 210/656 |
| 2008/0112972 | A1 | * | 5/2008 | Truong-Le | 424/204.1 |
| 2008/0127997 | A1 | * | 6/2008 | Jerg et al. | 134/10 |
| 2008/0149142 | A1 | * | 6/2008 | Jerg et al. | 134/25.2 |
| 2008/0229609 | A1 | * | 9/2008 | Bronshtein | 34/287 |
| 2008/0276486 | A1 | * | 11/2008 | Eichholz et al. | 34/513 |
| 2008/0276644 | A1 | * | 11/2008 | Eichholz et al. | 62/476 |
| 2008/0295875 | A1 | * | 12/2008 | Jerg et al. | 134/58 D |
| 2009/0102151 | A1 | * | 4/2009 | Merdzo | 280/79.5 |
| 2009/0145000 | A1 | * | 6/2009 | Ha et al. | 34/72 |

FOREIGN PATENT DOCUMENTS

| | | | |
|---|---|---|---|
| DE | 36 26 887 | | 2/1988 |
| DE | 37 10 710 | | 10/1988 |
| DE | 37 41 652 | | 6/1989 |
| EP | 0 358 279 | | 3/1990 |
| EP | 379741 | A1 * | 8/1990 |

(56) References Cited

FOREIGN PATENT DOCUMENTS

| | | | | |
|---|---|---|---|---|
| EP | 0 777 998 | | 6/1997 | |
| FR | 2 648 484 | | 12/1990 | |
| GB | 2 284 164 | | 5/1995 | |
| JP | 11033351 | A * | 2/1999 | |
| WO | WO 2005018409 | A1 * | 3/2005 | |
| WO | WO 2005042407 | A2 * | 5/2005 | |
| WO | WO 2005053504 | A1 * | 6/2005 | |
| WO | WO 2006061280 | A1 * | 6/2006 | |
| WO | WO 2006061292 | A1 * | 6/2006 | ..... A47L 15/42 |

* cited by examiner

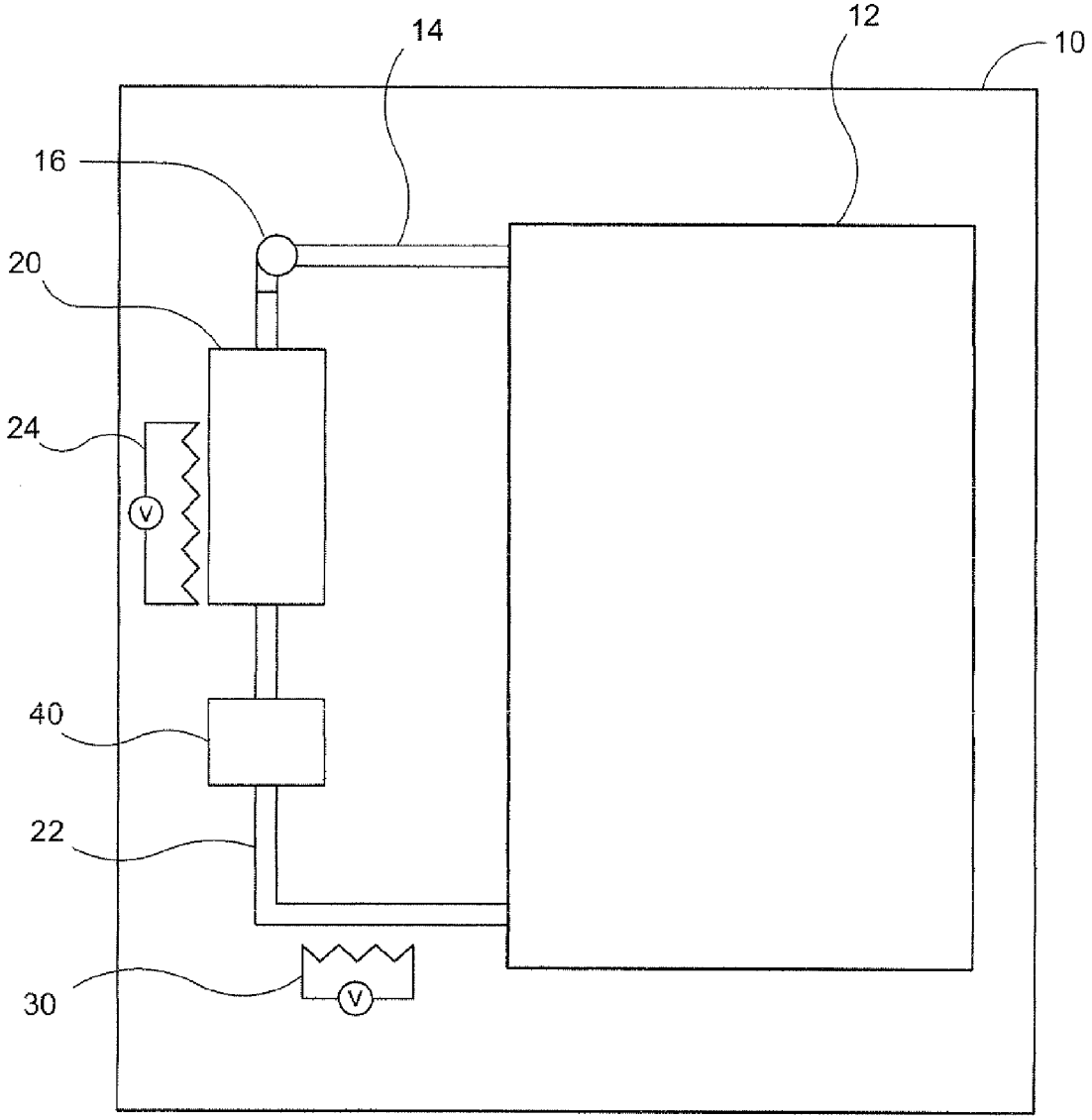
14
12
10
16
20
24
V
40
22
30
V

METHOD FOR OPERATING A DEVICE WITH AT LEAST ONE PARTIAL PROGRAMME STEP OF DRYING

FIELD OF TECHNOLOGY

The invention relates to a method for operating an appliance with at least one partial programme step "drying" such as is used, for example, in laundry driers, dishwashers, crockery driers, shoe driers etc.

BACKGROUND

Various methods are known for drying, for example, objects to be washed in a dishwasher. For example, the objects to be washed can be dried by own-heat drying if the rinsing liquid is heated in a partial programme step "clear rinse" and thus the objects to be washed which have undergone a hot clear rinse are dried by themselves by the self-heat of the objects to be washed which has thus built up during the drying process. In order to achieve this own-heat drying, the rinsing liquid is heated to a certain temperature in a heat exchanger in the "clear rinse" partial programme step and applied to the objects to be washed by means of spraying devices. As a result of the relatively high temperature of the rinsing liquid in the "clear rinse" partial programme step of usually 65° C. to 75° C., it is achieved that a sufficiently large quantity of heat is transferred to the objects to be washed so that water adhering to said objects to be washed vaporises as a result of the heat stored in the objects to the washed.

In a further known methods for drying the objects to be washed in dishwashers, a separate heat source, e.g. a hot air fan, is used to heat the moist air mixture during the drying process so that the air in the washing basket can absorb a larger quantity of moisture.

Dishwashers are known in which the moist air is vented outwards. This is disadvantageous since the surrounding kitchen furniture is damaged.

Thus, further methods are known in which the moist air is passed over condensing surfaces on which the moisture condenses before being guided out. This condensation is either passed into the washing basket or into special collecting containers.

A method of the type specified initially for dishwashers is known from DE 20 16 831 wherein the air from the washing container is guiding via a closable opening in the wall of the washing container onto reversibly dehydratable material and from there outwards via an opening. The desorption of the reversibly dehydratable material takes place during the standstill phase of the appliance wherein the water vapour produced is guided outwards again via the opening. As has already been explained above, this is disadvantageous since the surrounding kitchen furniture is damaged.

A disadvantage in the heating systems described above according to the prior art described further above is that the heating of the rinsing liquid is associated with a high energy requirement and the thermal energy required for each heating phase must be produced anew by means of electrical heating elements. The known heating systems also have the disadvantage that the heating of the rinsing liquid in the "clear rinse" partial programme step and the processes in the "drying" partial programme step are themselves associated with a high energy requirement and the thermal energy required is lost after the drying process.

SUMMARY OF THE TECHNOLOGY

It is thus the object of the present invention to provide a method which can be used to operate appliances of the type specified initially as economically as possible, to dry the items to be dried efficiently and to keep the associated energy expenditure as low as possible.

This object is solved by the dishwasher according to the invention having the features according to claim 1. Advantageous further developments of the present invention are characterised in the dependent claims.

In the method according to the invention for operating a device with at least one partial programme step of "drying", in the at least one partial programme step of drying, air is drawn from a treatment chamber and/or from ambient air through a sorption column and fed into the treatment chamber, wherein the sorption column contains reversibly dehydratable material and moisture is withdrawn from the air during the passage thereof.

In advantageous embodiment of this method, the air is heated during passage from the sorption column by heat of condensation and if necessary, is additionally heated by a heater.

As a result of using reversibly dehydratable material having hydroscopic properties, e.g. zeolite, it is not normally necessary to heat the items to be treated in the partial programme step preceding the "drying" partial programme step, e.g., in dishwashers in the "clear rinse" partial programme step. This makes it possible to achieve a considerable saving of energy. However, heating to low temperatures, e.g. to 30° C. is still appropriate during the "clear rinsing". As a result of heating the air by means of the sorption column, in which the condensation of the water vapour is released, its moisture absorption capacity is increased on each passage through the sorption column which leads to an improvement in the drying result and shortening of the drying time. Additional heating of the air using an additional heater in the "drying" partial programme step beyond the heating using the sorption column and thus, for example of the crockery in dishwashers, is not normally required because the thermal energy released in the sorption column is sufficient to heat the air to high temperatures, e.g. 70° C. The sorption column is heated to high temperatures, e.g. 150° C., by the heat of condensation.

In the preferably closed air system any exchange of contaminated air from the surroundings is completely eliminated, preventing any back contamination of the items to be treated. The present invention provides a method which can be used to operate appliances of the type specified initially as economically as possible, to dry the items to be dried efficiently and to keep the associated energy expenditure as low as possible.

According to a preferred feature of the invention, for desorption of the reversibly dehydratable material, air from the treatment chamber and/or ambient air is passed through the sorption column and into the treatment chamber and is heated during the passage thereof.

As is known, the reversibly dehydratable material is heated to very high temperatures for desorption for which thermal energy is required. In this case, the stored liquid emerges as hot water vapour. The water vapour is preferably guided into the treatment chamber of the appliance using an air stream and the air in the treatment chamber is thus heated and the treatment liquid, e.g. the washing solution and/or the objects to be cleaned, e.g. the crockery, is thereby also heated. The air which is passed through cools down whereby the water vapour contained therein condenses completely or partly. This preferably takes place as a closed air cycle. The introduction of the hot water vapour and the heated air into the treatment chamber during a partial programme step using treatment liquid to be heated or which has possibly already been heated, is largely sufficient to adequately heat the treatment liquid. Thus, further heating can largely be dispensed with and, apart from the small amount of energy required to overcome the binding forces between water and reversibly dehydratable material, the thermal energy used for desorption can be also completely used for heating the treatment liquid, e.g. the washing solution and/or the items to be cleaned, e.g. the crockery. In addition to the saving of energy, efficient cleaning of the items to be cleaned and treated is furthermore ensured.

In a further variant, the passage of air is undertaken during a partial programme step using treatment liquid to be heated.

In another embodiment for desorption of the reversibly dehydratable material, air is passed through the sorption column and heated and the air is then passed through a heat storage device for cooling and subsequently air for heating is passed through the heat storage device and into the treatment chamber for intermediate storage of the heat used for desorption in the heat storage device.

In an additional embodiment for desorption the sorption column or the air is heated by a heater in a pipe to the sorption column.

According to another advantageous variant, the treatment liquid and/or the goods to be treated are heated by the heated air which is passed through and the desorbed moisture from the sorption chamber is delivered at least partly in the treatment chamber or to the heat storage device.

Furthermore, in a partial programme step using treatment liquid to be heated e.g. "clear rinse", air from the treatment chamber and/or from ambient air is passed through a sorption column when the heating is switched off and into the treatment chamber, wherein the air is heated by the heat of condensation in the sorption column.

The invention is explained in detail hereinafter with reference to an exemplary embodiment of a method in a dishwasher.

BRIEF DESCRIPTION OF THE DRAWINGS:

FIG. 1 illustrates a dishwasher capable of performing drying and heating using a sorption column.

DETAILED DESCRIPTION

The method according to the invention for operating an appliance with at least one "drying" partial programme step is implemented in the exemplary embodiment explained with reference to a dishwasher, as shown in FIG. 1. It is known that a dishwasher has a washing method whose program run consists of at least one partial program step "pre-wash", a partial program step "clean", at least one partial program step "intermediate rinse", a partial program step "clear rinse" and a partial program step "dry". According to the invention, in the exemplary embodiment explained in the at least one "drying" partial programme step air from a treatment chamber is passed through a sorption column and then preferably back into the treatment chamber.

In the exemplary embodiment the treatment chamber 12 of the dishwasher 10—the washing container—is provided with an outlet in the upper area of the washing container for this purpose. From this outlet an air pipe 14 leads to a fan 16 and from the fan 16 to the sorption column 20.

This sorption column 20 contains reversibly dehydratable material which extracts moisture from the air during its passage and is thereby heated in a known fashion and thus the air which is passed through is also heated. In addition to this heating effect, it is also possible to additionally heat the air using a heater 24.

In the exemplary embodiment a further air pipe 22 runs from the sorption column 20 to an inlet located in a lower area of the washing container 12.

The heated air introduced into the washing container is completely dry and has a high absorption capacity for moisture. It rises upwards in the washing container and absorbs the residual moisture on the items to be treated—the objects to be washed. It is now fed to the sorption column again as has already been described above.

As a result of using reversibly dehydratable material, heating of the items to be treated is preferably not necessary, e.g. in the "clear rinse" partial programme step in dishwashers. This means a substantial saving of energy. As a result of the heating of the air, its moisture absorption capacity is increased on each passage through the sorption column, which leads to an improvement in the drying result and a shortening of the drying time. In the preferably closed air system an exchange of contaminated air from the surroundings is completely eliminated, preventing any back contamination of the treated items.

It is known that the reversibly dehydratable material has a limited liquid absorption capacity. In order to make this reusable, desorption is necessary where the reversibly dehydratable material is heated, to a high temperature and the liquid then emerges as vapour.

According to the invention, the desorption of the reversibly dehydratable material is preferably undertaken during a partial programme step using a treatment liquid to be heated.

In the exemplary embodiment the desorption of the reversibly dehydratable material is undertaken during a partial programme step "clean" and/or "pre-rinse" wherein the objects to be washed in a dishwasher are acted upon with heated treatment liquid—washing solution—using spray devices. A heater 24 is located in the sorption column 20, for example, which heats the reversibly dehydratable material to high temperature is heated for this purpose.

According to the invention, during the desorption of the reversibly dehydratable material air from a treatment chamber is passed, for example, using an outlet through a sorption column and then back into the treatment chamber, for example, using an inlet wherein the air is heated by a heater during its passage.

In the exemplary embodiment during a "clean" partial programme step air is extracted from the washing container by means of the afore-mentioned fan and is pressed through the sorption column. The hot water vapour emerging from the sorption column and the now heated air enter into the washing container through the afore-mentioned inlet and there impact upon the circulating washing solution and/or crockery which is thereby heated.

The introduction of the hot water vapour and the heated air into the treatment chamber during a partial programme step using treatment liquid to be heated or which has possibly already been heated, is largely sufficient to adequately heat the treatment liquid and/or the crockery. Thus, further heating can largely be dispensed with and, apart from the small amount of energy required to overcome the binding forces between water and reversibly dehydratable material, the thermal energy used for desorption can be also completely used for heating the treatment liquid (washing solution) and/or the crockery. In addition to the saving of energy, efficient cleaning of the items to be cleaned and treated is furthermore ensured.

In a further embodiment of the invention, the desorption of the reversibly dehydratable materials is not carried out during a partial programme step using treatment liquid to be heated but at an arbitrary other time by intermediate storage of the energy released during desorption in a heat storage device 40, e.g. using a medium which liquefies under high melting heat or a latent storage device and if necessary, delivering this to a treatment liquid to be heated and/or the crockery. As a result, for example, if the thermal energy used for desorption is greater than that required in a partial programme step, this excess energy can advantageously be used in a later partial programme step using treatment liquid to be heated.

As described above, the sorption column is preferably heated using a heater during a partial programme step using treatment liquid to be heated to a very high temperature, e.g. 300° C. so that the sorption column delivers the absorbed water.

During the "drying" partial programme step the sorption column is also heated to high temperatures, e.g. 150-200° C. by the heat of condensation of the water vapour or the moisture. As a result, the dry air introduced into the washing container or the air with water vapour can reach temperatures which can result in damage to crockery, e.g. plastic parts. In a further embodiment the air inlet temperature in the washing chamber must be lowered by means of cooling to such an extent that no damage occurs.

In the "drying" partial programme step, for this purpose residual water is passed onto or around the inlet opening and the air flow is therefore cooled. In addition, the dry and warm air absorbs some of the water which leads to cooling of the air flow as a result of the evaporation cold. In a partial programme step using the treatment liquid to be heated, heat exchange takes place with water vapour at the inlet opening as a result of the spray water and the air flow. The inlet opening is advantageously applied so that the air flow does not impact directly on the crockery and sufficient cooling of the air flow takes place as a result of the spray water.

In addition to the heating for heating the sorption column for desorption, hereinafter called air heating, in an embodiment not shown a dishwasher according to the invention has a flow heater for the washing solution if this is not dispensed with as a result of the present invention. If, in a further embodiment, heating is required in the "clear rinse" partial programme step, this can either be achieved using the flow heater as is known from the prior art or using the air heating with the fan switched on. The advantage of heating using the air heating is that in the following "drying" partial programme step the thermal energy stored in the sorption column can be used for drying.

In a further variant, during the partial programme step using treatment liquid to be heated, e.g. "clear rinse" the fan is switched on when the air heating is switched off.

As a result, moist air is passed through the sorption column, which absorbs the moisture and the released condensation energy heats the sorption column and therefore also the air which is passed through. The condensation heat can thus be used to heat the washing solution and/or the crockery. The sorption column should be designed such that a good drying result can also be achieved in the "drying" partial programme step.

The present invention provides a method which can be used to operate appliances of the type specified initially as economically as possible, to dry the items to be dried efficiently and to keep the associated energy expenditure as low as possible.

The invention claimed is:

1. A method for operating a home appliance, comprising:

subjecting items retained in the home appliance to a drying step after the items have undergone a treatment step as a result of which moisture remains on the items, the step of drying including drawing at least one of air from a treatment chamber and ambient air through a sorption column and thereafter guiding the air that has passed through the sorption column into a treatment chamber, the sorption column containing reversibly dehydratable material that operates to withdraw moisture from air during the passage of the air through the sorption column; and effecting desorption of the reversibly dehydratable material in the sorption column via drawing at least one of air from the treatment chamber and ambient air through the sorption column by means of an air accelerator means, subjecting air passing through the sorption column to heating, and guiding the air that has been heated as it passed through the sorption column into the treatment chamber, wherein the air which is guided into the treatment chamber heats at least one of a treatment liquid to be applied to the items retained in the home appliance and the items themselves.

2. The method according to claim 1, wherein effecting desorption of the reversibly dehydratable material includes heating air during its passage through the sorption column by heat of condensation and a selected one of additional heating via a heater and no additional heating via a heater.

3. The method according to claim 1, wherein the passage of air is undertaken during a programme step using treatment liquid to be heated.

4. The method according to claim 1, wherein effecting desorption of the reversibly dehydratable material includes heating air during its passage through the sorption column and thereafter passing the air through a heat storage device for cooling in order to intermediately store the heat used for desorption in the heat storage device, and further including thereafter passing air for heating purposes through the heat storage device and into the treatment chamber.

5. The method according to claim 1, wherein effecting desorption of the reversibly dehydratable material includes heating the air via a heater in a pipe to the sorption column.

6. The method according to claim 4, wherein at least one of the treatment liquid and the items are heated by the heated air and effecting desorption of the reversibly dehydratable material includes at least partly delivering the desorbed moisture from the sorption column into at least one of the treatment chamber or the heat storage device.

7. The method according to claim 1, wherein effecting desorption of the reversibly dehydratable material includes heating the air via the heat of condensation in the sorption column.

8. The method according to claim 1, wherein the step of guiding the air that has been heated as it passed through the sorption column into the treatment chamber includes cooling the air that has been heated at a location intermediate the sorption column and the treatment chamber.

9. The method according to claim 8, wherein cooling the air that has been heated at a location intermediate the sorption column and the treatment chamber includes contacting the air that has been heated with a liquid having a temperature less than the air such that at least some evaporation of the liquid occurs, whereupon a cooling of the air takes place as a result of evaporation cooling.

10. The method according to claim 1 and further comprising a step of drawing air from at least one of a source of air consisting of air from the treatment chamber and a source of air consisting of ambient air through the sorption column by means of an air accelerator means after the step of effecting desorption of the reversibly dehydratable material in the sorption column, this step including drawing such air through the sorption column from the respective source of air substantially without imparting heat to the air from after the air exits the respective source of air up to its entry into the sorption column, the air drawn through the sorption column being heated within the sorption column via heat of condensation as liquid is condensed from the air and absorbed by sorption material in the sorption column, and guiding the air that has been heated as it passed through the sorption column into the treatment chamber, whereupon the air guided into the treatment chamber heats at least one of a treatment liquid to be applied to the items retained in the home appliance and the items themselves.

11. A method for operating a dishwasher, the method comprising:

subjecting crockery retained in the dishwasher to a drying step after the crockery has undergone a treatment step as a result of which moisture remains on the crockery, the step of drying including drawing at least one of air from a treatment chamber and ambient air through a sorption column and thereafter guiding the air that has passed through the sorption column into a treatment chamber, the sorption column containing reversibly dehydratable material that operates to withdraw moisture from air during the passage of the air through the sorption column; and effecting desorption of the reversibly dehydratable material in the sorption column via drawing at least one of air from the treatment chamber and ambient air through the sorption column by means of an air accelerator means, subjecting air passing through the sorption column to heating, and guiding the air that has been heated as it passed through the sorption column into the treatment chamber, wherein the air guided into the treatment chamber heats at least one of a treatment liquid to be applied to the crockery retained in the device and the crockery themselves.

* * * * *

UNITED STATES PATENT AND TRADEMARK OFFICE

CERTIFICATE OF CORRECTION

PATENT NO. : 8,601,716 B2
APPLICATION NO. : 10/562105
DATED : December 10, 2013
INVENTOR(S) : Jerg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1672 days.

Signed and Sealed this
Twenty-second Day of September, 2015

Michelle K. Lee

Michelle K. Lee
*Director of the United States Patent and Trademark Office*